United States Patent [19]

Sutton

[11] 4,430,889

[45] Feb. 14, 1984

[54] DYNAMIC FLUID TESTING APPARATUS AND METHOD

[75] Inventor: David L. Sutton, Duncan, Okla.

[73] Assignee: Halliburton Company, Duncan, Okla.

[21] Appl. No.: 326,541

[22] Filed: Dec. 2, 1981

[51] Int. Cl.[3] ..... G01N 15/08

[52] U.S. Cl. ..... 73/61.4; 73/38; 73/432 SD

[58] Field of Search ..... 73/61.4, 38, 432 SD; 210/413

[56] References Cited

U.S. PATENT DOCUMENTS

| | | | |
|---|---|---|---|
| 2,908,390 | 10/1959 | Rich et al. | 210/413 |
| 3,055,208 | 9/1962 | Gallus | 210/413 |
| 3,286,510 | 11/1966 | Parker | 73/61.4 |
| 3,289,467 | 12/1966 | Parker et al. | 73/61.4 |

*Primary Examiner*—Stephen A. Kreitman

*Attorney, Agent, or Firm*—W. J. Beard

[57] ABSTRACT

A fluid loss test can be performed using a housing having a substantially cylindrical core disposed therein and having a cage paddle structure disposed therein substantially coaxially around the core thereby permitting continuous agitation and even fluid shear rates to be maintained during test periods. The core has an axial opening defined therein through which lost fluid permeating the core can be collected. The core is secured in the housing so that reverse flow permeability tests can be conducted thereon. Although secured in the housing during tests, the core is removable therefrom so that filter cakes applied to the core can be analyzed. The housing is maintained within a system which permits successive fluids to be introduced into the housing while maintaining substantially constant system pressure. Additionally, measured volumes of fluid can be introduced into the housing.

11 Claims, 3 Drawing Figures

DYNAMIC FLUID TESTING APPARATUS AND METHOD

This invention relates generally to apparatus and methods for dynamically testing a fluid and more particularly, but not by way of limitation, to apparatus and methods for conducting fluid loss tests, fluid flush and wash tests, fluid spacer tests, and reverse flow permeability tests on fluids used or found in oil or gas wells.

In drilling and completing a hole for an oil or gas well, drilling mud is pumped into the hole during the drilling operation. This mud adheres to the wall of the well and forms a filter cake. Once the hole has been drilled, a casing tubing is lowered into the hole. To set the casing and bond it to the formation, a cement slurry is pumped into the annulus between the tubing and the wall of the hole. To insure that the cement adequately bonds to the wall of the hole, it is desirable to remove from the annulus and formation wall as much of the filter cake and mud as is possible prior to pumping the cement slurry into the annulus. This flushing of the mud and filter cake is achieved by introducing suitable flush and/or wash fluids into the annulus.

So that the various fluids (such as the flush and/or wash fluids) which are to be pumped into the well can be pumped successively without interrupting the pumping process, spacer fluids are used between the different types of fluids to separate them in the fluid column as it is pumped into the well.

Because the downhole conditions in a well vary from one well to the next, it is desirable to test particular types of drilling mud, flush fluids, wash fluids, spacer fluids, and cement slurries or the like to determine their suitability under the particular relevant downhole conditions (such as temperature, pressure and agitation). For example, wash fluids are sold and used on the basis of their compatability with particular types of drilling muds and cement slurries and on the basis of their ability to remove mud and filter cake from the annulus and wall of the well. Thus, it is desirable to test whether a particular wash fluid is suitable for use with the particular mud and slurry to be used in a specific well and to test whether the wash can remove a sufficient amount of the mud and filter cake from the specific well.

Additionally, when a cement slurry is pumped into the annulus of a well, a portion of the slurry is lost into the adjacent formation of the well hole. The amount of fluid loss to be expected with a particular slurry in a specific well is an important consideration for one designing the actual cementing slurry which is most desirable for that well and for one analyzing downhole conditions for predicting annular gas flow or gas leakage. The amount of fluid loss to expect from a particular slurry is also an important consideration for one designing a squeeze job in which the slurry will be forced into a fracture or fissure within the formation.

Therefore, there is the need for a compact and economical apparatus and method for conducting tests on such fluids which are to be prepared for use in downhole environments.

There is also the need for such apparatus and method to provide for simulating the downhole structure so that its reverse flow permeability can be tested to simulate oil and gas production and to determine formation damage from filtrates. Additionally, the actual downhole structure often is saturated with brine or other fluid, and thus it is desirable to be able to simulate the structure to more closely approximate the actual downhole conditions during a test.

There is currently test equipment which can be used for conducting fluid loss tests such as the standard American Petroleum Institute (API) fluid loss test and the high temperature high pressure (HTHP) API fluid loss test. However, such test equipment and the test results obtained therefrom have several shortcomings. One shortcoming is that such equipment generally does not provide a close simulation of the actual downhole conditions, and the test results are not reliable for predicting annular gas flow or for determining the amount of fluid loss additive needed. For example, such equipment often is unable to agitate the test fluid during the period a fluid loss test is being conducted. Where such agitation is provided, it is frequently provided with uneven shear rates between the test fluid and the medium used to simulate the downhole structure. Furthermore, such equipment cannot successively introduce fluids into the test location while maintaining substantially constant pressure. It is important to be able to introduce successive fluids while maintaining pressure so that the sequence of fluids which will actually be contacting the downhole formation can be duplicated during the test.

Further shortcomings include such equipment often being large and cumbersome and requiring several hours to conduct a single test.

These test equipment also generally provide no preconditioning of the simulation structural material representing the downhole structure. Such simulation material is also often difficult to remove from the test equipment and thus is hard to analyze. Still further, the simulation material is not secured against reverse flow so that reverse flow permeability tests of the simulation material cannot be conducted.

Another shortcoming of the previous equipment is the lack of means for conducting flush, wash and spacer fluid tests.

By way of specific examples of previous equipment, simple HTHP fluid loss cells known in the art provide no means for stirring the test fluid either before or during a fluid loss test. Fluid loss cells which do provide for stirring only provide such stirring before the fluid loss test is cnducted. Modifications of stirred fluid loss cells can provide stirring during the actual test; however, such stirring is achieved by means which affords poor duplication of the shear rate from test to test and which creates uneven shear rates across the simulation structure surface. Large pump-through test equipment known in the art are cumbersome to use and seldom provide the range of shear rates needed for a complete study of fluid loss. Neither the stirred fluid loss cells nor the large pump-through equipment are satisfactory for evaluating wash fluids. Neither the HTHP fluid loss cells nor the pump-through models provide easy removal of the simulation structure without disturbing filter cakes deposited thereon. Furthermore, the simulation structures in the typical HTHP fluid loss cells are not secured against reverse flow thereby preventing reverse flow permeability tests to be run.

The present invention overcomes the above-noted and other shortcomings of the prior art by providing a novel and improved method and apparatus for dynamically testing fluids. The present invention provides an apparatus and method for determining the fluid loss from an oil or gas well cementing slurry or the like under conditions such as high temperature, high pressure, and fluid agitation occurring both before and during the actual fluid loss test. The agitation occurs at a controllable shear rate which is substantially the same across the entire interface area between the test fluid and a filter medium representing the downhole structure. The present invention is also useful for evaluating flush, wash and spacer fluids used ahead of the primary cement slurry to remove mud and filter cake from the well bore and for conducting reverse flow permeability tests.

Broadly, the apparatus of the present invention includes a housing, filter means disposed in the housing for providing a path through which a test fluid can pass from an exterior surface of the filter means to the interior of the filter means, and movement means for moving the fluid at a controllable fluid shear rate relative to the filter means along an interface between the fluid and the filter means. More particularly, the device includes a cylindrical filter core as at least a portion of the filter means. The core is surrounded by a rotating cage paddle forming the movement means. The core and cage are contained in a high pressure vessel forming the housing. The core has a hollow center which is vented to the outside of the vessel, and the core is mounted in the vessel so that it can be disturbing without distubing a filter cake which can be deposited thereon as a part of the filter means. This latter feature permits direct observation of the effectiveness of flush, wash and spacer fluids for removing the filter cake.

The pressure vessel has an inlet and an outlet which can be connected into a system which permits fluids to be successively flowed through the vessel without relieving pressure in the vessel. This permits successive fluids to be flowed through the vessel in a manner simulating the flow of fluids into and through a well.

The core can be pre-conditioned with brine or other fluids to insure the core closely simulates the downhole structure. The core is also mounted in the vessel so that it is secured against reverse flow thereby permitting reverse flow permeability tests to be conducted on the core.

The present invention permits relatively quick fluid loss tests to be conducted with relatively compact equipment which can be carefully controlled to closely simulate downhole conditions. The apparatus can be controlled so that agitation creating even shear rates across the interface between the filter core and the test fluid are maintained. Additionally, flush, wash and spacer fluid evaluation tests and reverse flow permeability tests can be conducted.

Therefore, from the foregoing it is a general object of the present invention to provide a novel and improved apparatus and method for dynamically testing fluids. Other and further objects, features and advantages of the present invention will be readily apparent to those skilled in the art when the following description of the preferred emodiment is read in conjunction with the accompanying drawings.

Figure 1:
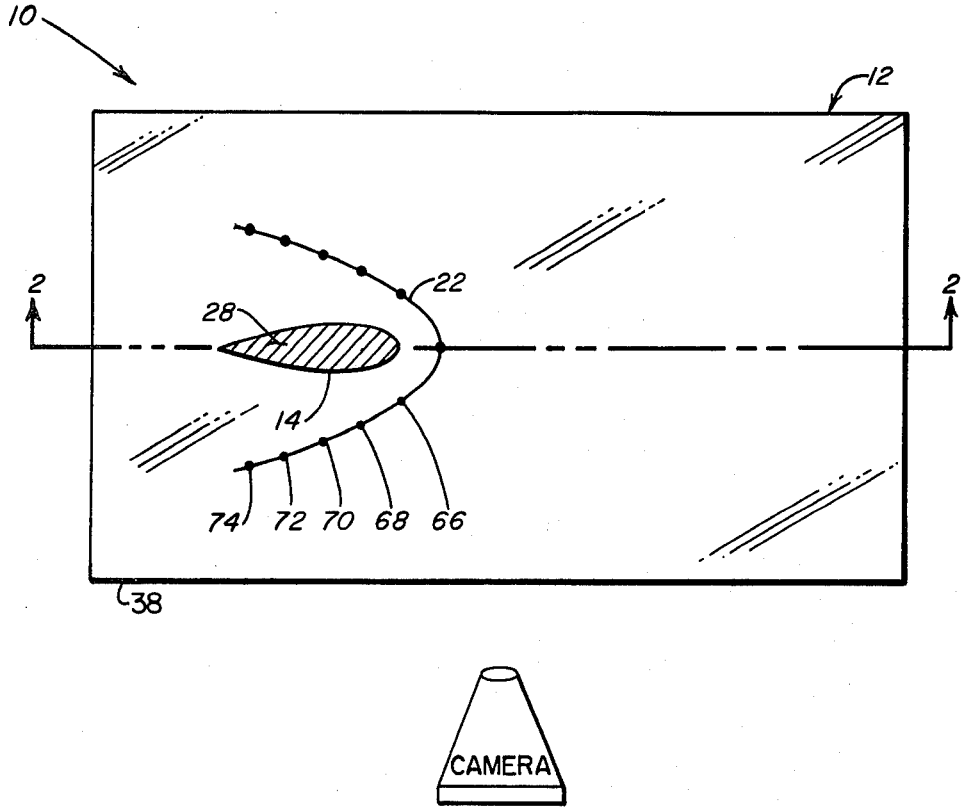
FIG. 1 is a schematic illustration of the system embodying the present invention.

With reference to FIG. 1 a system embodying the present invention will be described. The present invention includes a test chamber 2 having an inlet 4, a first outlet 6, a second outlet 8, and a vent 10. Associated with the test chamber 2 are a drive means 12 and a collecting means 14 which will be more particularly described hereinbelow with reference to FIG. 2.

Connected to the inlet 4 of the test chamber 2 is a test fluid injector means 16. This connection is effected by means of a conduit 18 connecting an outlet of the test fluid injector means 16 with the inlet 4. Disposed in the conduit 18 are valves 20 and 22. The test fluid injector means 16 provides the source of the fluids which are to be introduced into the test chamber 2 for pre-conditioning the test chamber or which are to be the test material. In the preferred embodiment the test fluid injector means 16 includes a stirring autoclave with a quick opening top and a heating jacket as are known in the art. The test fluid injector means 16 injects the fluid into the test chamber under pressure. The test fluid injections can be either heated or unheated, stirred or unstired as test conditions require.

The system disclosed in FIG. 1 also includes an exit fluid receiver means 24 having an inlet 26 connected to the outlet 6 of the test chamber 2 by means of a conduit 28 having a valve 30 and a valve 32 disposed therein. The exit fluid receiver means 24 also includes an outlet 34 and a drain 36. The exit fluid receiver means 24 is any suitable pressure vessel capable of receiving a pressurized fluid from the test chamber 2.

Connected to the outlet 34 of the exit fluid receiver means 24 is a specific volume transfer chamber 38 which is also within the system shown in FIG. 1. The connection from the outlet 34 is made by means of a conduit 40 joining with an inlet 42 of the transfer chamber 38. Disposed in the conduit 40 is a needle valve 44. The transfer chamber 38 permits measured volumes of fluids to be injected into or withdrawn from the test chamber 2 while maintaining a constant or substantially constant pressure. This is achieved by appropriately controlling the flow through the conduit 40 and the valve 44 between the exit fluid receiver 24 and the transfer chamber 38 because the volume of a high pressure gas transferred from a high pressure chamber to a lower pressure chamber is approximately equal to the volume of the low pressure chamber multiplied by the high pressure and divided by the low pressure. In the system shown in FIG. 1, the high pressure chamber is the exit fluid receiver 24 and the lower pressure chamber is the specific volume transfer chamber 38. The transfer chamber 38 is any suitable apparatus as known in the art. A volume calibrated hand pump, such as a Ruska pump, or other suitable device can be substituted for the chamber 38.

The system also includes a high pressure nitrogen source 46 connected within the system as illustrated in FIG. 1. The purpose of the high pressure nitrogen source 46 is to supply nitrogen to the points needed to facilitate drainage of the test chamber under a high system pressure. Appropriate manifolding means is used in the nitrogen source 46.

Thus, the system as illustrated in FIG. 1 provides means for flowing fluid into the test chamber 2 under pressure at a first time, means for flowing another fluid into the test chamber 2 under pressure at a second time, and means for maintaining pressure in the test chamber 2 between the first time and the second time substantially constant. Additional fluids can also be introduced into the test chamber 2 at additional times as required. The fluids include brine, drilling mud, cement slurries, flushes, washes, spacers, or other suitable fluids.

Figure 2:
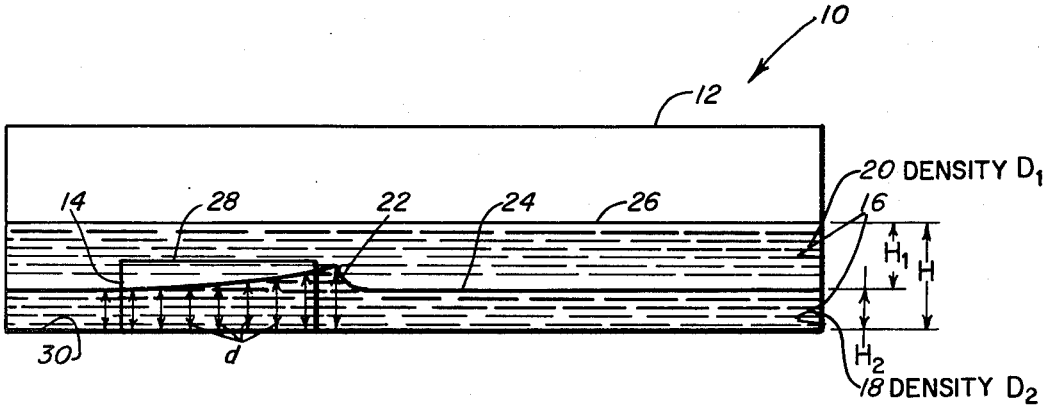
FIG. 2 is a schematic sectional elevational view of the preferred embodiment of the test chamber of the present invention.

With reference primarily to FIG. 2 the preferred embodiments of the test chamber 2, the drive means 12 and the collecting means 14 will be described. The test chamber 2 includes a compact housing preferably comprising a pressure vessel as shown in FIG. 2 to include a substantially cylindrical container 48 having a lid 50 threadedly and pressure-sealingly connected thereto. The container 48 has an opening defined in a side wall thereof to provide the outlet 6 and has another opening defined in a bottom wall thereof to provide the outlet 8. The lid 50 includes openings defined therein to provide the inlet 4 and the vent 10. The valve 22 is shown threadedly connected to the inlet 4, and a vent valve means 52 is shown threadedly connected to the vent opening 10.

Suitably attached to the exterior surface of the container 48 is heating means for heating a fluid within the vessel. As schematically illustrated in FIG. 2 the heating means includes a plurality of strip heater elements 54 of a type known in the art. The heating means also includes a thermocouple 56 for controlling the strip heater elements 54.

The pressure vessel has a cavity 58 defined therein by the interior surfaces of the container 48 and the lid 50. The cavity 58 can receive a fluid through the inlet 4. In the preferred embodiment the pressure vessel is one which can withstand approximately 5,000 to 10,000 pounds per square inch of pressure on a fluid contained in the cavity 58. A fluid in the cavity 58 can also be heated in the preferred embodiment to a temperature of up to approximately 500° F. by means of the strip heater elements 54.

Disposed in the cavity 58 of the housing is a filter means for providing a path through which a fluid in the cavity 58 can pass from an exterior surface of the filter means to the interior of the filter means. In the preferred embodiment the filter means includes a medium of porous or permeable material specifically shown as comprising a substantially cylindrical core 60 having an outer surface 62 which defines the exterior surface of the filter means when no filter cake is deposited thereon. A filter cake can be deposited on the core 60 by the means of the system shown in FIG. 1 acting on the surfaces 62 through the introduction of driling mud into the cavity 58. The core 60 further has an interior opening 64 defined therein. In the preferred embodiment the opening 64 is axially disposed within the substantially cylindrical core. The core 60 is any suitable material (such as sandstone, metal or plastic, for example) which can be used to simulate the mineral formation of the downhole environment in which the test fluid is to be used.

Fluid which passes through the porous material of the core 60 into the opening 64 is vented to the exterior of the container 48 through a mandrel tube 66. The mandrel tube 66 has a wall defining a hollow interior region in the tube, and the tube is constructed so that fluid passing through the porous core 60 into the opening 64 enters the hollow interior region of the tube 66. In the preferred embodiment this construction includes a plurality of holes, illustrated in FIG. 2 as holes 67, defined in and through the wall of the mandrel tube 66. The tube 66 extends out of the opening 64 defined in the core 60 and passes through the second outlet 8 so that fluid in the hollow interior region of the tube 66 can pass to the exterior of the vessel The portion of the tube 66 extending into the opening 64 of the core 60 lies adjacent the interior surface of the porous means defining the opening 64.

In the preferred embodiment the opening 64 passes through the entire length of the core 60 so that the mandrel tube 66 passes through the core 60 and attaches to a core cap 68 capping one end of the core 60. The other end of the mandrel tube 66 passes out of the container 48 through the outlet 8 and is there engaged by a nut 70 which pulls the mandrel tube 66 and the core cap 68 connected thereto down to thereby lock the core 60 in place within the cavity 58 of the vessel. The nut 70 works against a yoke 72 which is disposed between the nut 70 and the bottom wall of the container 48.

As shown in FIG. 2 the first end of the core 60 is sealed by a sealing gasket 74 disposed between the first end surface of the core 60 and the core cap 68, and the second end of the core 60 is sealed by a sealing gasket 76 disposed between the second end surface of the core 60 and the bottom interior surface of the container 48. The passage of the mandrel tube 66 through the outlet 8 in the bottom wall of the container 48 is sealed with a packoff assembly 78 disposed in the yoke 72.

The present invention also includes movement means for moving the fluid within the cavity 58 at a controllable fluid shear rate relative to the filter means along an interface between the fluid and the filter means. This interface includes the exterior or outer surface 62 of the core 60 or the exterior surface of a filter cake if one is applied to the outer surface 62 by suitable means of the system. This fluid movement means specifically is used for moving the fluid in the cavity adjacent the core 60 or the filter cake when a portion of the fluid is passing through the core 60 into the hollow interior region of the mandrel tube 66.

The preferred embodiment of the movement means includes a cage paddle having a plurality of stirring elements 80 spaced from the outer surface 62 of the core 60. In the preferred embodiment the stirring elements 80 are disposed substantially parallel to the axially extending opening 64 and the mandrel tubing 66 disposed therein. As shown in FIG. 2, each stirring element 80 is elongated and extends along the length of the core 60.

The stirring elements 80 are retained in spaced relation to each other and to the exterior surface of the core and the filter cake, if one is applied to the core, by suitable means, such as an upper retaining ring 82 and a lower retaining ring 84. The lower retaining ring 84 defines a central opening through which the core 60 extends in substantially coaxial and concentric relationship with the cage paddle. The cage paddle is rotatably mounted in the cavity 58 of the pressure vessel so that it can be rotated relative to the core 60. The rotatable cage paddle enables stirring of the test fluid to continue during an actual fluid loss test. The elongated stirring elements 80 eliminate uneven fluid shear rates at the filter medium surface.

So that the speed of rotation of the cage paddle, and thus the rate of the fluid shear, can be varied over a desirable range, the movement means also includes the drive means 12. In the preferred embodiment the drive means 12 includes a variable speed motor 86 illustrated in FIG. 1. The preferred embodiment of the drive means also includes magnetic means for magnetically coupling to the cage paddle a variable rotative force provided by the variable speed motor so that the cage paddle moves the fluid in the cavity 58 adjacent the surface 62 of the core 60 (or adjacent the surface of a filter cake applied to the core) to impart a controllable shear at the interface between the fluid and the surface 62. Alternatively, the variable speed motor can be directly mechanically coupled to the cage paddle by means of a shaft packed off with a suitable high pressure packing. The preferred magnetic form is illustrated in FIG. 2 by the structure identified by the reference numeral 88. In the embodiment shown in FIGS. 1 and 2, the motor 86 is connected to the structure 88 by means of a suitable drive belt 90. When the cage paddle is driven, it rotates around the fixed core 60 resulting in an even distribution of fluid shear rate across the surface 62 of the core 60 or the surface of a filter cake applied to the surface 62.

To measure the quantity of fluid lost during a fluid loss test, the apparatus further includes the collecting means 14 for collecting the fluid passing through the core 60 to the opening 64 and the interior of the tubing 66. The collecting means may include any suitable structure, but is preferably shown in FIG. 2 to include valves 92 and 94 and a pressurized receiver means 96. This structure is connected to the mandrel tube 66 by means of a suitable connector element 98.

Broadly, the method of the present invention by which a fluid loss test is conducted on a fluid used in a well defined by a permeable structure includes the steps of placing the fluid in fluid communication with the structure-simulating permeable filter core 60 so that a portion of the fluid can permeate the filter core and of moving the fluid relative to the filter core 60 so that a shear rate is achieved at an interface between the fluid and the filter core as the fluid permeates through the filter means. The method also includes collecting the quantity of the fluid permeated through the filter means. The method also includes initially mounting the filter, such as the cylindrical permeable core 60, in the pressure vessel and pressurizing the fluid in fluid communication with the core.

In the embodiment shown in FIG. 2 the test fluid is flowed substantially axially or longitudinally past the exterior surface 62 of the core 60 as the cavity 58 is filled with the fluid. A portion of the fluid permeates the core 60 and then flows substantially axially or longitudinally out of the opening 64 through the hollow interior of the mandrel tube 66. Simultaneous with the substantial axial flow and permeation by the fluid, a circumferential component of movement can be imparted to the fluid by rotating the cage paddle substantially co-axially with respect to the core while the core is maintained fixed.

To determine the quantity of fluid lost over a predetermined time, the step of collecting the quantity of fluid permeated through the filter means is conducted for a predetermined period of time as known in the art. Collecting the fluid is performed by appropriately operating the elements 92, 94 and 96 as known in the art.

Figure 3:
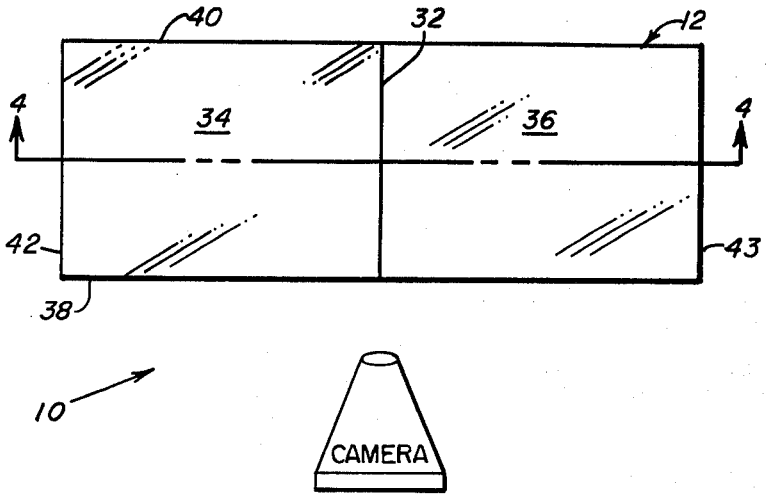
FIG. 3 is a schematic sectional elevational view of the filter core having a filter cake deposited thereon.
Figure 4:
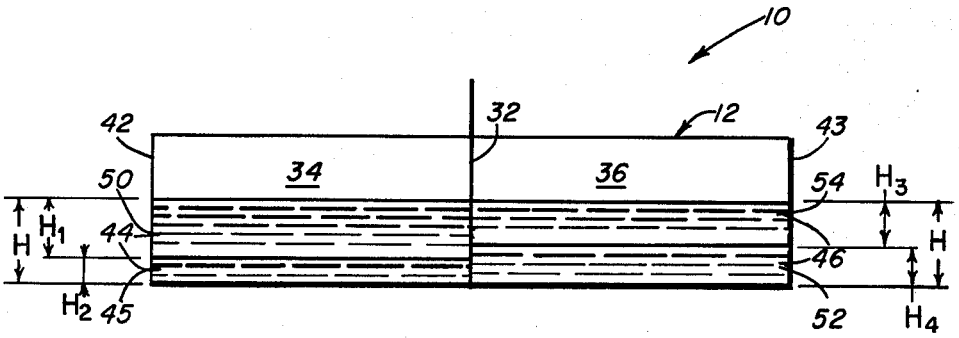
Figure 5:
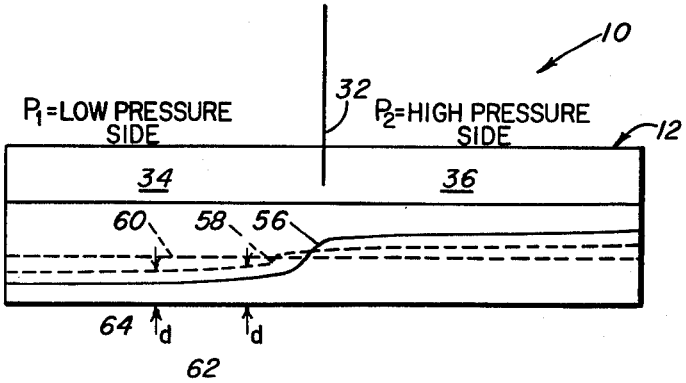
Figure 1:
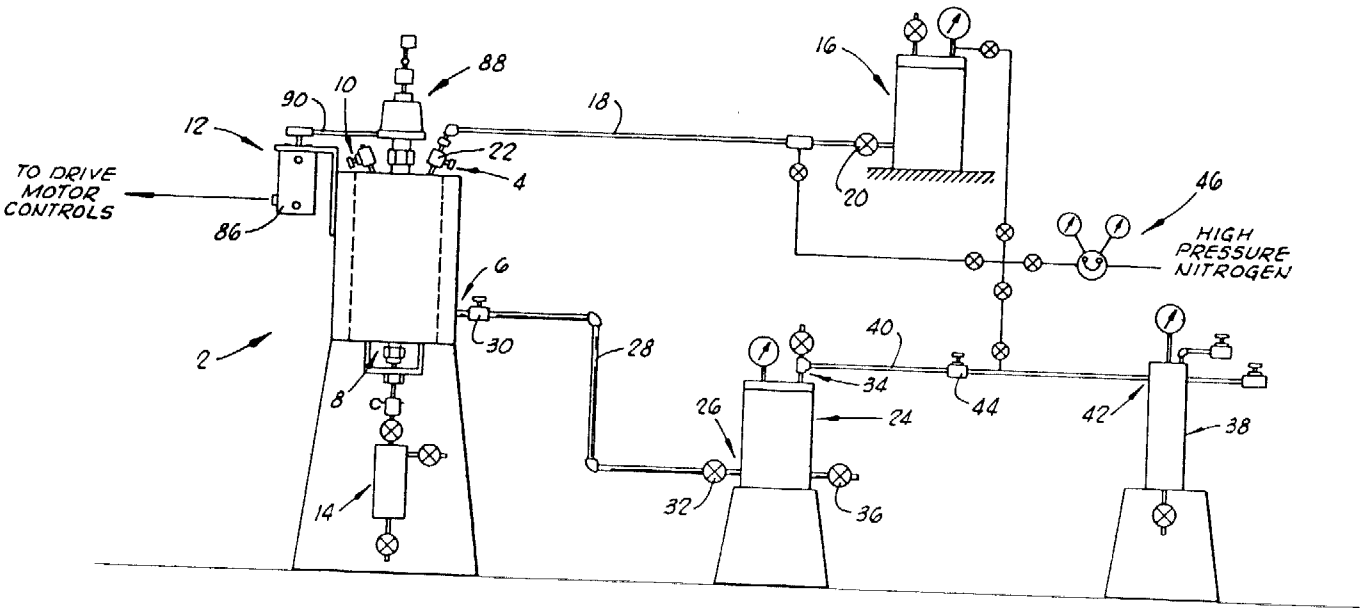
Figure 2:
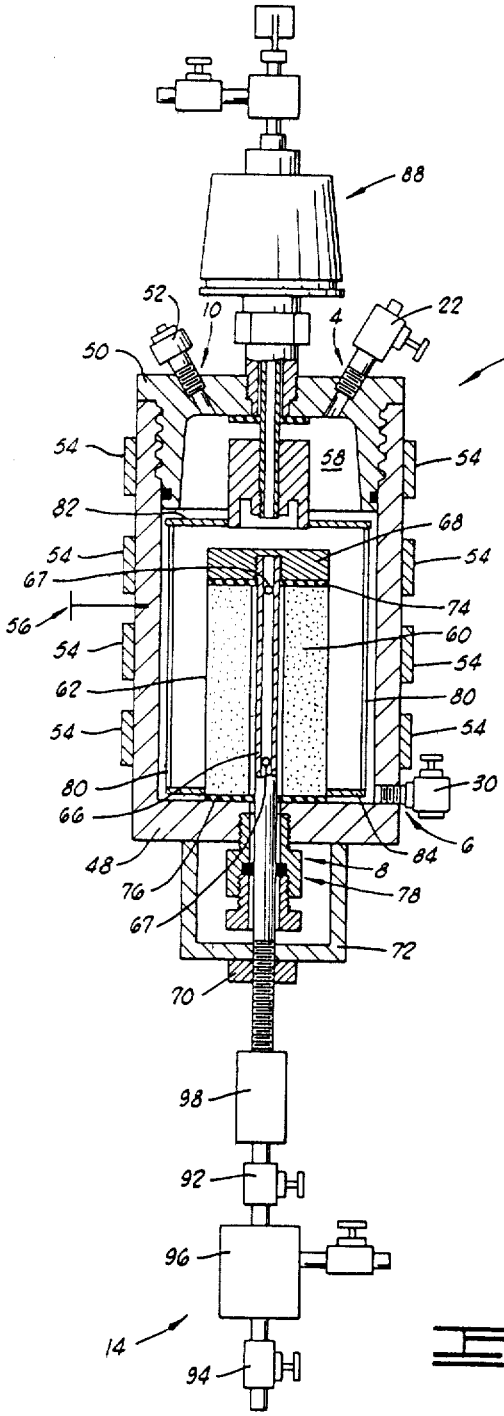
Figure 3:
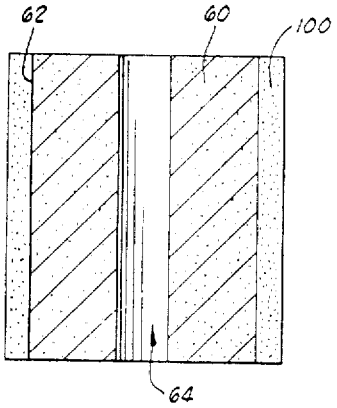

The operation further comprises, prior to the step of flowing the test fluid past the core, the step of treating the core 60 to closely simulate the permeable structure of the well. This step includes saturating the core with simulated formation water, such as brine, and applying a filter cake of drilling mud to the exterior surface 62 of the core 60. An illustration of a filter cake 100 applied to the exterior surface 62 of the core 60 is illustrated in FIG. 3.

The method furter includes, after the step of applying a filter cake but before the step of flowing the test fluid past the core, the step of flowing a wash fluid past the filter cake. A flushing fluid can also be flowed past the filter cake.

The method still further comprises, after the step of flowing a flush and/or wash fluid, the step of removing the core from the vessel for determining the amount of filter cake remaining applied to the core 60.

The method also includes the step of heating the fluid which is in fluid communication with the filter core 60. The method still further includes the step of maintaining pressure in the vessel during the steps of treating the core, flowing the test fluid past the core, simultaneously imparting a circumferential component of movement to the fluid, and collecting the quantity of the fluid passing into the opening of the core.

By way of a more specific example of the operation of the present invention, a filter means treatment substance such as simulated formation water (e.g., brine) is initially placed in the cavity 58 and the core 60 is saturated with the simulated formation water by using either a flow-through or vacuum procedure which are understood by those familiar with the art of high temperature, high pressure fluid loss testing. Once the core has been saturated, the formation water is drained through the outlet 6 and the valve 30.

Next, a known quantity of drilling mud or the like is injected into the cavity 58 through the valve 22 and the inlet 4. The pressure vessel is then pressurized to the specified test pressure, such as a pressure up to 10,000 pounds per square inch.

With the vessel pressurized, the cage paddle is rotated by the motor 86 at the specified speed for the particular test in progress.

Heat is next applied to the vessel by means of heater elements 54 as controlled by the thermocouple 56. When the test temperature is reached, valve 92 is opened to start a fluid loss test period. The fluid lost during this period is measured in accordance with procedures understood by those in the art.

As required by the specific test being performed, the drilling mud can be agitated or allowed to remain static during the test period when the fluid is permeating the core. After the drilling mud test and/or the pre-conditioning period, the drilling mud is drained while maintaining total system pressure. Although the drilling mud is drained, some of the drilling mud remains adhered to the core 60 and forms a filter cake. The approximate thickness of the filter cake is known from the quantity of drilling mud originally injected and the amount lost during the test and drained.

A measured volume of wash or spacer fluid is then injected into the test chamber, agitated as required and then removed.

Next, the test slurry is injected into the cavity 58 through the inlet 4 and the valve 22 and the amount of fluid lost through the core 60 is measured using procedures similar to those described above and understood by those in the art.

To evaluate a wash fluid for mud and filter cake removal, the following tests are performed. Initially, the foregoing steps are terminated while the cement slurry is still fluid. The fluid slurry is drained from the chamber and the core 60 is removed from the cavity 58. The filter cake remaining on the core is cut through to the surface 62 of the core 60 and partially removed so that the thickness of both the mud and cement filter cakes can be determined. The effectiveness of the wash which was used during the wash sequence is then compared to the results of another test during which either no wash or a plain water wash was used.

To determine the reverse flow permeability, the fluid permeability of the core is measured from the inside to the outside of the core both before and after the fluid loss test is performed. The result is compared to another test using a plain water wash. To determine the permeability of the core, a known volume of fluid is injected through the valve 92, the mandrel tube 66, the core 60, and into the cavity 58. The pressure differential between the valve 92 and the cavity 58 is measured, and the time period is measured. Knowing the volume injected, the pressure differential, the time period and the geometry of the core 60, the permeability is calculated as known in the art.

From the foregoing it is apparent that the various tests can be conducted under continuous agitation throughout the entire fluid loss test period. Additionally, the shear rate over the entire core surface is substantially the same. The shear rate can be varied from zero to high turbulence and can be duplicated on successive tests.

Using the system illustrated in FIG. 1, test fluids can be changed without opening the test chamber 2 or relieving the pressure therein. Thus, it is possible to simulate a period of mud circulation followed by a period of mud flushing before measuring the fluid loss of a cement slurry. Furthermore, no outside mechanical pumps are required to circulate the test fluid past the fluid medium as required by previous systems capable of changing test fluids under pressure.

Still further, the test chamber 2 is easy to disassemble and clean and is constructed to permit the filter medium to be easily removed for inspection or replacement.

Thus, the present invention is well adapted to carry out the objects and attain the ends and advantages mentioned above as well as those inherent therein. While a preferred embodiment of the invention has been described for the purpose of this disclosure, numerous changes in the construction and arrangement of parts can be made by those skilled in the art, which changes are encompassed within the spirit of this invention as defined by the appended claims.

What is claimed is:

1. An apparatus for dynamically testing a fluid, comprising:

a housing;

filter means, disposed in said housing, for providing a path through which the fluid can pass from an exterior surface of said filter means to the interior of said filter means;

movement means for moving the fluid at a controllable fluid shear rate relative to said filter means along an interface between the fluid and said filter means;

means for flowing the fluid into said housing under pressure at a first time;

means for depositing at a second time a filter cake to define said exterior surface of said filter means; and means for flowing another fluid into said housing under pressure at a third time, a portion of said another fluid passing through said filter means;

wherein the fluid includes a filter means treatment substance; said filter cake includes a drilling mud; and said another fluid includes a cement slurry.

2. An apparatus as defined in claim 1, wherein said filter means includes a substantially cylindrical core having an outer surface and further having an interior opening defined in said core, said core being porous to permit a portion of the fluid to pass from said outer surface to said interior opening.

3. An apparatus as defined in claim 1, further comprising means for maintaining pressure in said housing between said first time and said third time.

4. An apparatus as defined in claim 3, wherein said filter means includes a substantially cylindrical core having an outer surface and further having an interior opening defined in said core, said core being porous to permit a portion of the fluid to pass from said outer surface to said interior opening.

5. An apparatus as defined in claim 1, fruther comprising means for collecting the portion of said another fluid passing through said filter means.

6. A system for dynamically testing fluids, comprising;

a housing;

a medium simulating a downhole formation, said medium disposed in said housing;

means, associated with said housing, for conducting a fluid loss test utilizing a first test fluid and said medium;

means, associated with said housing, for performing a reverse flow permeability test on said medium;

means, associated with said housing, for applying a filter cake to said medium; and means, associated with said housing, for flowing a second test fluid through said housing to wash at least a portion of said filter cake from said medium.

7. A method of performing a fluid loss test on a test fluid used in a well defined by a formation including a permeable structure, comprising:

mounting a cylindrical permeable core in a pressure vessel, said core having an exterior surface and an interior surface, said interior surface defining an opening;

treating the core to simulate the permeable structure, said step of treating the core including:

saturating the core with simulated information water; and applying a filter cake of drilling mud to the exterior surface of the core;

flowing the test fluid under pressure substantially axially past the exterior surface of the core so that a portion of the test fluid permeates the core and passes into the opening;

imparting, substantially simultaneously with the step of flowing the test fluid, a circumferential component of movement to the test fluid flowing past the core; and collecting the quantity of the test fluid passing into the opening during a predetermined period of time.

8. A method as defined in claim 7, further comprising, after the step of applying a filter cake but before the step of flowing the test fluid, the step of flowing a wash fluid past the filter cake.

9. A method as defined in claim 8, further comprising, after the step of flowing a wash fluid, the step of removing the core from the vessel for determining the amount of filter cake remaining applied to the core.

10. A method as defined in claim 7, further comprising maintaining pressure in the vessel during the steps of treating the core, flowing the test fluid, imparting a circumferential component of movement to the test fluid, and collecting the quantity of the test fluid passing into the opening.

11. A method of testing a wash fluid used for washing drilling mud from the wall of a well, comprising:

mounting in a vessel a core simulating the wall of the well;

applying to the core a filter cake of the drilling mud having a known thickness;

flowing the wash fluid past the filter cake;

removing the core from the vessel; and determining the thickness of the filter cake remaining applied to the core.

* * * * *

UNITED STATES PATENT AND TRADEMARK OFFICE

CERTIFICATE OF CORRECTION

PATENT NO. : 4,430,889

DATED : February 14, 1984

INVENTOR(S) : David L. Sutton

It is certified that error appears in the above-identified patent and that said Letters Patent is hereby corrected as shown below:

The title page should be deleted to appear as per attached title page.

Sheets 1 and 2 of the drawings should be deleted and the attached sheets substituted.

Signed and Sealed this

*Twenty-second* Day of *January 1985*

[SEAL]

*Attest:*

DONALD J. QUIGG

*Attesting Officer*

*Acting Commissioner of Patents and Trademarks*

United States Patent [19]

Sutton

[11] 4,430,889

[45] Feb. 14, 1984

[54] DYNAMIC FLUID TESTING APPARATUS AND METHOD

[75] Inventor: David L. Sutton, Duncan, Okla.

[73] Assignee: Halliburton Company, Duncan, Okla.

[21] Appl. No.: 326,541

[22] Filed: Dec. 2, 1981

[51] Int. Cl.[3] ..... G01N 15/08

[52] U.S. Cl. ..... 73/61.4; 73/38; 73/432 SD

[58] Field of Search ..... 73/61.4, 38, 432 SD; 210/413

[56] References Cited

U.S. PATENT DOCUMENTS

| | | | |
|---|---|---|---|
| 2,908,390 | 10/1959 | Rich et al. | 210/413 |
| 3,055,208 | 9/1962 | Gallus | 210/413 |
| 3,286,510 | 11/1966 | Parker | 73/61.4 |
| 3,289,467 | 12/1966 | Parker et al. | 73/61.4 |

*Primary Examiner*—Stephen A. Kreitman

*Attorney, Agent, or Firm*—W. J. Beard

[57] ABSTRACT

A fluid loss test can be performed using a housing having a substantially cylindrical core disposed therein and having a cage paddle structure disposed therein substantially coaxially around the core thereby permitting continuous agitation and even fluid shear rates to be maintained during test periods. The core has an axial opening defined therein through which lost fluid permeating the core can be collected. The core is secured in the housing so that reverse flow permeability tests can be conducted thereon. Although secured in the housing during tests, the core is removable therefrom so that filter cakes applied to the core can be analyzed. The housing is maintained within a system which permits successive fluids to be introduced into the housing while maintaining substantially constant system pressure. Additionally, measured volumes of fluid can be introduced into the housing.

11 Claims, 3 Drawing Figures

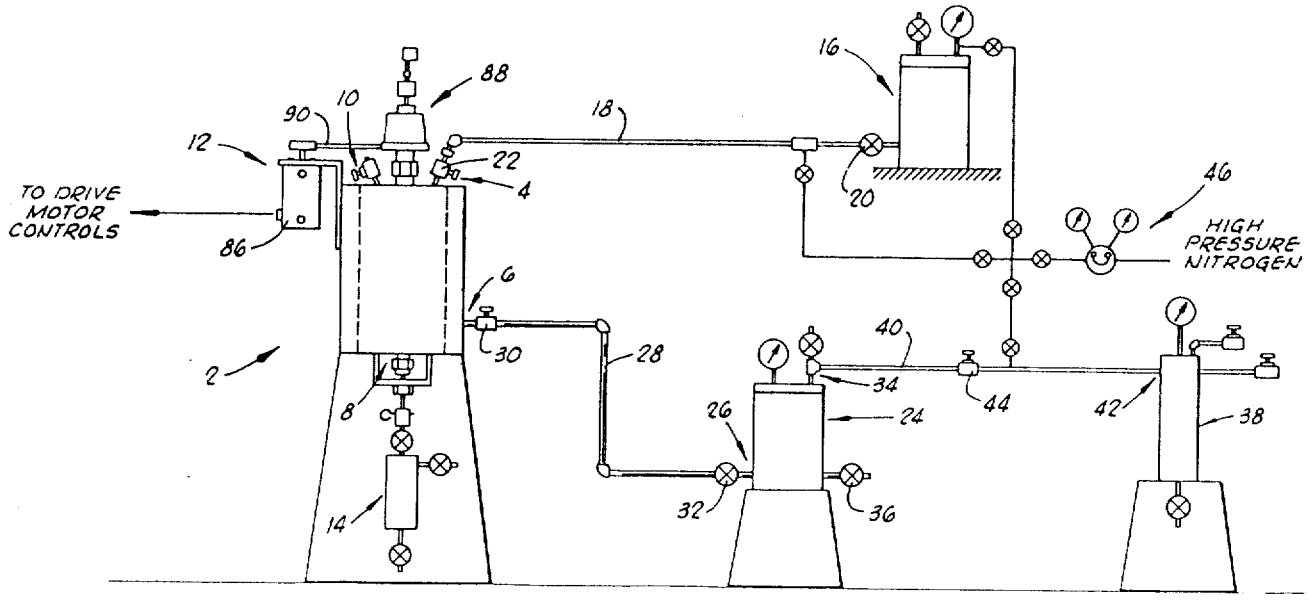

SHEET 1 OF 2